US008122936B2

(12) United States Patent
Attridge et al.

(10) Patent No.: US 8,122,936 B2
(45) Date of Patent: Feb. 28, 2012

(54) ANTI-VEINING AGENT FOR METAL CASTING

(75) Inventors: Jon H. Attridge, Waxhaw, NC (US); Joshua M. Werling, Fishers, IN (US)

(73) Assignee: Prince Minerals, Inc., New York, NY (US)

( * ) Notice: Subject to any disclaimer, the term of this patent is extended or adjusted under 35 U.S.C. 154(b) by 0 days.

(21) Appl. No.: 12/942,441

(22) Filed: Nov. 9, 2010

(65) Prior Publication Data

US 2011/0048279 A1 Mar. 3, 2011

Related U.S. Application Data

(62) Division of application No. 12/143,052, filed on Jun. 20, 2008.

(51) Int. Cl.

| | |
|---|---|
| ***B22C 9/10*** | (2006.01) |
| ***B22C 1/02*** | (2006.01) |
| ***B22C 1/22*** | (2006.01) |
| ***B32B 17/06*** | (2006.01) |
| ***B32B 15/00*** | (2006.01) |

(52) U.S. Cl. ..... 164/369; 164/523; 164/529; 428/426; 428/432

(58) Field of Classification Search ..... 428/402, 428/403, 406, 426, 432, 689, 699, 702; 164/369, 164/520, 523, 529; 106/38.2, 38.9

See application file for complete search history.

(56) References Cited

U.S. PATENT DOCUMENTS

| | | | | |
|---|---|---|---|---|
| 5,621,036 | A * | 4/1997 | Geoffrey et al. | 524/431 |
| 5,911,269 | A * | 6/1999 | Brander et al. | 164/523 |
| 5,962,567 | A * | 10/1999 | Geoffrey et al. | 524/431 |
| 6,719,835 | B2 * | 4/2004 | Brown | 106/38.2 |
| 6,972,302 | B2 * | 12/2005 | Baker et al. | 523/139 |
| 2009/0114365 | A1 * | 5/2009 | Cieplewski et al. | 164/529 |

* cited by examiner

*Primary Examiner* — Jerry Lorengo
*Assistant Examiner* — Noah Wiese
(74) *Attorney, Agent, or Firm* — Jonathan D. Ball; King & Spalding

(57) ABSTRACT

Additives to foundry sand cores are provided for reducing or eliminating surface defects in metal castings. The additives general comprise an iron oxide component and a glass component which is preferably free of lithium oxide.

9 Claims, No Drawings

ANTI-VEINING AGENT FOR METAL CASTING

This application is a divisional application of U.S. patent application Ser. No. 12/143,052, filed Jun. 20, 2008, the contents of which are hereby incorporated by reference in their entirety.

FIELD OF INVENTION

The present invention relates generally to sand mold and core aggregates having a reduced propensity for cracking during metal casting. More particularly, the invention relates to additive compositions for inclusion in sand molds and cores for reducing defects on metal casts.

BACKGROUND OF THE INVENTION

Sand cores are shaped solid aggregates of sand which are used in foundries for making metal castings. The sand cores are usually placed in a mold to define the internal recesses of the casting. When molten metal is poured over the sand core, the rapid rise in temperature causes thermal expansion of the sand mass, often resulting in the formation of cracks in the core. These cracks allow molten metal to penetrate the core and form fin-shaped imperfections on the surface of the casting which are known in the art as veins.

Various additives have been proposed for reducing the cracking of sand cores during casting. For example, Industrial Gypsum Co.'s U.S. Pat. No. 5,911,269, the disclosure of which is hereby incorporated by reference for all purposes, describes adding a lithia-containing additive, such as α-spodumene, to sand cores to reduce thermal expansion defects. The lithia-containing material is added to the sand core in an amount sufficient to provide about 0.001% to about 2.0% lithia. The patent speculates that α-spodumene absorbs free silica during casting to form β-spodumene, which is said to have extremely low thermal expansion.

ICG Technologies, Inc. (Milwaukee, Wis.) markets a lithia-containing anti-veining agent under the name VEINSEAL® 14000. This material comprises 60-70% by weight $SiO_2$, 10-20% by weight $Fe_3O_4$, 15-25% by weight $Al_2O_3$, 10-25% by weight $TiO_2$ and 2-5% by weight $Li_2O$. While effective at reducing veining, this material is expensive, costing about $720 per ton.

U.S. Pat. No. 6,972,302, the disclosure of which is hereby incorporated by reference for all purposes, describes the addition of $Fe_2O_3$ to sand cores to reduce the amount of VEINSEAL® 14000 needed to eliminate thermal expansion of sand cores and the formation of vein defects during metal casting. The patent states that the minimum effective concentration of VEINSEAL® 14000, when used alone, is 5% by weight of the sand cores. However, it is said the addition of 1% by weight of $Fe_2O_3$ allows the amount VEINSEAL® 1400 to be reduced to about 1% to about 3.5% by weight of the sand cores, resulting in substantial cost savings.

Despite these advances, there is still a need in the art for additives for inclusion in sand cores which reduce or eliminate surface defects (veining) in metal castings. It is an object of the present invention to provide anti-veining additives which substantially reduce or eliminate cracking of sand cores during metal casting and, as a result, prevent or reduce the appearance of veins on the surface of the metal cast. It is another object of the invention to provide effective anti-veining additives that are more cost effective than those currently available.

The foregoing discussion is presented solely to provide a better understanding of nature of the problems confronting the art and should not be construed in any way as an admission as to prior art nor should the citation of any reference herein be construed as an admission that such reference constitutes "prior art" to the instant application.

SUMMARY OF THE INVENTION

In accordance with the foregoing objectives and others, the present invention provides compositions for addition to sand cores which reduce or substantially eliminate vein formation during metal casting. The anti-veining additive compositions generally comprise (i) an iron oxide component and (ii) a glass component.

The iron oxide component may suitably comprise a mixture of two or more different iron oxide materials, such as for example, a combination of (a) from about 20 to about 70% by weight iron(III) oxide and (b) from about 20 to about 70% by weight iron(II,III) oxide. The iron(III) oxide is typically the mineral hematite and is referred to herein as Red Iron Oxide. The iron(II,III) oxide is typically the mineral magnetite and is referred to herein as Black Iron Oxide. The iron oxides each are typically comprised predominately of particles having a particle size less than about 75 microns, which is to say that the majority of the material will pass through a 200 mesh (Tyler) screen.

The glass component is any glass that melts rapidly in the presence of iron oxides under casting conditions and includes inexpensive glasses such as soda-lime-silica (e.g., container glass, window plate glass, glass cullet) and borosilicate glasses. In one embodiment, the additive comprises from about 10 to about 60% by weight of a glass that is essentially free of lithium oxide.

The additive compositions may optionally include an amount of carbon, such as graphite (e.g., amorphous graphite), coke, or charcoal, effective to reduce adhesion of sand particles to the casting. When present, the amount of carbon will typically be from about 0.1% to about 25% by weight, based on the weight of the additive composition.

In one aspect of the invention, a method is provided for making a sand core comprising blending together, in any order, core sand, an effective amount of binder, an iron component, and a glass component and forming the mixture into a sand core. In one variant, the method comprises blending together core sand, an effective amount of binder (e.g., a phenolic urethane cold box resin), and from about 3% to about 10% by weight, based on the weight of sand, of an anti-veining additive according to the invention and forming the mixture into a sand core.

Sand cores for use in metal casting are also provided comprising an aggregate of sand, from about 3% to about 10% by weight, based on the weight of sand, of an anti-veining additive according to the invention, and amount of binder, such as a phenolic urethane cold box resin, in an amount sufficient to form a unitary mass.

These and other aspects of the invention will be better understood by reading the following detailed description and appended claims.

DETAILED DESCRIPTION

All terms used herein are intended to have their ordinary meaning in the art unless otherwise provided. Where reference is made herein to the composition of the anti-veining additive, the components are given in terms of "% by weight," which refers to the weight percent of each component based on the weight of the entire anti-veining additive composition. In contrast, when referring to the sand core composition, the term "% by weight," refers to the weight percent of each components based on the weight of sand.

It has surprisingly been found that the use of expensive lithia-containing glasses, such as the α-spodumene used in VEINSEAL® 14000, is not necessary to achieve good protection against vein formation in metal castings. Rather, it has been discovered that any glass which rapidly softens or melts under foundry temperatures, including for example soda-lime silica or borosilicate glasses, may be employed with beneficial results and at a fraction of the cost of the lithia-containing glasses.

The principal components of the anti-veining additives of the invention are iron oxide and glass. These components are typically blended together as an intimate admixture, with additional optional ingredients, to form the anti-veining additive composition of the invention. The anti-veining additive composition is combined with sand and binder to form sand-based aggregates useful as molds and cores in foundries for metal casting. Alternatively, the iron oxide and glass components may be separately added to the sand, along with a binder, to form the aggregates without first forming an intimate admixture of iron oxide and glass. The anti-veining additives are suitable for use in no-bake molds, cores and resin coated shell sand applications to improve castings by eliminating veining, penetration, pinholes, burn in, burn on and lustrous carbon casting defects and reducing cleaning room labor.

Without wishing to be bound by any particular theory, it is believed that under foundry operating temperatures (e.g., about 2,400 to about 2,700° F.), iron oxides form a molten glass between the grains of sand which increases the plasticity, and thus reduces cracking, of the sand core. The presence of iron oxides is believe to have the additional advantage of trapping gases released from binder decomposition. In the broadest aspect of the invention, there is essentially no restriction on the nature of the iron oxide component and it is contemplated that iron(II) oxide (ferrous oxide), iron(III) oxide (ferric oxide), iron(II,III) oxide (ferrous ferric oxide), or any combination thereof may be employed.

More typically, the iron oxide component will comprise iron(III) oxide or iron(II,III) oxide, and preferably a combination of the two. In one embodiment, the iron oxide component will comprise, consist essentially of, or will consist of iron(III) oxide ($Fe_2O_3$), which is also known as or ferric oxide. The mineral hematite ($\alpha$-$Fe_2O_3$), also called Red Iron Oxide, is the preferred form of iron(III) oxide. In another embodiment, the iron oxide component will comprise, consist essentially of, or will consist of iron(II,III) oxide ($Fe_3O_4$), also known as ferrous ferric oxide or Black Iron Oxide. The mineral magnetite (lodestone) is a suitable source of iron(II, III) oxide. In a preferred embodiment, the iron oxide component will comprise, consist essentially of, or will consist of a combination of iron(III) oxide and iron(II,III) oxide; particular mention being made of combinations of hematite and magnetite. Where the iron component "consists essentially of" a particular iron oxide or combination of iron oxides, it will be understood that the presence of additional iron oxide species in quantities sufficient to measurably impact the temperature or rate at which the iron oxide component melts will be excluded.

The iron oxide materials are preferably milled powders of small particle size, such that the material passes through a 100 mesh (Tyler) sieve, or more typically passes through a 115 mesh, 150 mesh, 170 mesh, 200 mesh, 250 mesh, 270 mesh, or 325 mesh sieve. These small particles enable rapid melting of the iron oxide. However, it should be noted that an excessive amount of fines may increase the amount of binder required to achieve an adequate tensile strength of the core. A higher binder demand may be less advantageous as it may result in the production of greater quantities of gas on heating which can adversely affect the mold.

The iron oxide component will typically comprise from about 40 to about 90% by weight of the anti-veining additive composition. More typically, the iron oxide component will comprise from about 50% to about 70% by weight, and preferably from about 55% to about 65% by weight of the anti-veining additive composition. Where the iron oxide component comprises both iron(III) oxide and iron(II,III) oxide, each will typically comprise from about 20% to about 70% by weight, more typically from about 25% to about 45% by weight, of the anti-veining composition. Of course, the foregoing weight ranges may vary considerably depending on the presence of additional optional components in the anti-veining additive composition. What is important is that the amount of iron oxide added to the sand is in the range of about 0.5% to about 5% by weight, preferably from about 1% to about 3% by weight, based on the weight of sand.

In some embodiments, the anti-veining additive compositions will comprise, in addition to Red Iron Oxide and Black Iron Oxide, an amount of Rouge Iron Oxide. The Rouge Iron Oxide will suitably comprise from about 1% to about 20% by weight of the additive composition, preferably from about 5% to about 15% by weight of the additive composition, and more preferred still from about 8% to about 12% by weight of the additive composition.

The second principal component of the anti-veining compositions of the invention is a glass material. In the broadest aspect of the invention, there is essentially no restriction on the nature of the glass. What is considered important is that the glass be capable of liquefying quickly or acting as a flux at casting temperatures. The glass may have a high coefficient of thermal expansion or a low coefficient of thermal expansion, as it is not believed that the thermal expansion of the glass measurably impacts the integrity of the sand core.

Preferred for use in the anti-veining additive compositions of the invention are silicate glasses. Suitable silicate glasses include, without limitation, soda-lime-silica glass, borosilicate glass, E-glass (alumino-borosilicate glass), fitted glasses and A-glass (cullet), to name a few.

Particular mention may be made of soda-lime-silica glass, including window plate glass and container glass. While any window plate and container glass is contemplated to be suitable, representative window plate and container glasses will typically comprise from about 70-75% by weight $SiO_2$, from about 12-17% by weight $Na_2O$, and from about 7-12% by weight CaO as the predominant constituents and may further comprise from about 0.1-2% by weight $Al_2O_3$, from about 0.01-2% by weight $K_2O$, from about 0.01-5% MgO, and typically less than about 1% by weight, in the aggregate, of other oxides, including without limitation $TiO_2$, PbO, and $Fe_2O_3$.

Also suitable are borosilicate glasses. While any borosilicate glass is contemplated to be suitable, representative borosilicate glasses typically comprise from about 70-85% by weight $SiO_2$ and from about 9-14% by weight $B_2O_3$ as the predominant components and may further include about 4-9% by weight $Na_2O$, about 0.1-9% by weight $K_2O$, from about 0.1-2% by weight CaO, and as an optional component from about 0.1-5% by weight $Al_2O_3$.

The glass is typically provided in powdered or comminuted form, such as is the case with glass cullet. It has been found to be desirable to employ particle sizes that are sufficiently small to optimize rapid flux. Glass cullet that passes through an 80 mesh (Tyler) sieve but that is retained on a 170 mesh sieve has been found particularly useful. In other words, the glass particles according to this embodiment may have a particle size (diameter) below about 177 microns and above about 88 microns.

In one embodiment, the glass will comprise less than 1.5% by weight $Li_2O$. In other embodiments, the glass will comprise less than about 1% by weight, less than about 0.5% by weight, less than about 0.1% by weight, less than about 0.05% by weight, or less than about 0.01% by weight $Li_2O$. In some embodiments, the glass will be essentially free of $Li_2O$ by which is meant that (i) the amount of $Li_2O$ present is so insubstantial as to not have a measurable impact on the rate of flux of the glass, and/or (ii) the amount of $Li_2O$ present is not more than trace levels normally associated with a particular non-lithia containing glass.

The additive composition may optionally comprise an amount of carbon sufficient to reduce the adhesion of sand grains to the casting. The carbon may be, for example, graphite, charcoal, coke, or the like. In a preferred embodiment, an amorphous graphite is used. When present, the carbon typically comprises from about 0.1 to about 25% by weight of the additive composition. More preferably, the carbon may comprise from about 5% to about 20% by weight of the additive composition, and in a particular embodiment will comprise from about 10% to about 15% by weight of the anti-veining additive composition.

The sand used for making the sand cores may be any sand suitable for metal casting, including without limitation, silica sand, zircon sand, olivine sand, chromite sand, lake sand, bank sand, fused silica, or the like.

Any binder used for making sand cores is contemplated to be suitable for use in the practice of the invention, including without limitation, those known to be suitable for so-called non-bake, cold box, or hot box systems. Suitable polymeric binders, include without limitation, polyurethanes, phenolic urethane, furan urea resins, polyester binders, acrylic binders, and epoxy binders, to name a few. Particular mention may be made of phenolic urethane resins.

The binder will typically be added to the sand in an effective amount by which is meant an amount suitable for imparting the desired cohesiveness to the sand core. The binder will typically, but not necessarily, comprise from about 0.1 to about 10% by weight, based on the weight of sand, and more typically will comprise from about 0.5% to about 5% by weight, based on the weight of sand.

In one embodiment, the anti-veining additive composition and/or the sand-based aggregate to which the anti-veining additive composition has been added will be free of, or substantially free of, lithium-bearing minerals such as, without limitation, lithia, α-spodumene, amblygonite, montebrasite, petalite, lepidolite, zinnwaldite, eucryptite or lithium carbonate. By "substantially free of" lithium-bearing minerals is meant that the amount of lithium present is no more than the trace amounts that would normally be associated with the particular non-lithium-based components (e.g., soda lime silicate glass, silica sand, etc.). In other embodiments, the amount of lithium oxide ($Li_2O$) in the sand-based aggregates of the invention will be less than 0.001% by weight, preferably less than 0.0005% by weight, and more preferred still, less than 0.0001% by weight.

EXAMPLE 1

An anti-veining additive according to the invention is provided in Table 1.

TABLE 1

| Ingredient | Weight % |
|---|---|
| Red Iron Oxide | 26 |
| Black Iron Oxide | 26 |
| Rouge Iron Oxide | 10 |
| Mixed Window Plate glass | 25 |
| Amorphous Graphite | 13 |
| Total | 100 |

The anti-veining is added to sand in an amount between about 3% and about 6% by weight, based on the weight of sand.

All references including patent applications and publications cited herein are incorporated herein by reference in their entirety and for all purposes to the same extent as if each individual publication or patent or patent application was specifically and individually indicated to be incorporated by reference in its entirety for all purposes. Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

The invention claimed is:

1. An anti-veining additive composition for sand cores used in metal casting, said composition comprising:

(a) from about 20 to about 70% by weight iron(III) oxide;

(b) from about 20 to about 70% by weight iron(II,III) oxide; and (c) from about 10 to about 60% by weight of a glass that is substantially free of lithium oxide;

wherein said iron (III) oxide, iron, (II,III) oxide, and glass are blended toether in intimate admixture; wherein said iron(III) oxide and said iron(II,III) oxide are each comprised predominately of particles having a particle size less than about 75 microns; and wherein said anti-veining additive is substantually free of lithium-bearing minerals.

2. The composition according to claim 1, wherein said iron(III) oxide comprises hematite.

3. The composition according to claim 1, wherein said iron(II,III) oxide comprises magnetite.

4. The composition according to claim 1, wherein said glass comprises soda-lime-silica glass.

5. The composition according to claim 4 wherein said soda-lime-silica glass is selected from the group consisting of container glass, window plate glass, glass cullet, and combinations thereof.

6. The composition according to claim 5, wherein said soda-lime-silica glass is cullet.

7. The composition according to claim 1, wherein said glass comprises borosilicate glass.

8. The composition according to claim 1, further comprising from about 0.1 to about 25% by weight carbon.

9. The composition according to claim 8, wherein said carbon comprises amorphous graphite.

* * * * *